United States Patent [19]

Kunstadt

[11] Patent Number: 4,915,009

[45] Date of Patent: Apr. 10, 1990

[54] STRINGED ELECTRIC MUSICAL INSTRUMENT WITH INDEPENDENTLY SUSPENDED SET-UP MODULE

[76] Inventor: Robert M. Kunstadt, 470 W. End Ave., New York, N.Y. 10024

[21] Appl. No.: 195,509

[22] Filed: May 18, 1988

[51] Int. Cl.[4] ..... G10H 3/00; G10H 1/32; G10H 3/18; G10D 3/00

[52] U.S. Cl. ..... 84/743; 84/291; 84/293; 84/726; 84/731; 84/744

[58] Field of Search ..... 84/1.01, 1.14, 1.15, 84/1.16,314 R, 314 N, 267, 274, 275, 277, 281, 282, 290, 291, 293, 294, 299 R, 299-302

[56] References Cited

U.S. PATENT DOCUMENTS

| | | | |
|---|---|---|---|
| 961,589 | 6/1910 | Elsmore | 84/282 |
| 2,122,396 | 7/1938 | Freeman | 84/312 |
| 2,335,244 | 11/1943 | Gugino | 84/293 |
| 3,251,257 | 5/1966 | Bunker | 84/267 |
| 3,535,975 | 10/1970 | Broussard | 84/293 |
| 3,538,232 | 11/1970 | Bachtig et al. | 84/1.14 |
| 3,858,480 | 1/1975 | Schneider et al. | 84/1.16 |
| 4,168,647 | 9/1979 | Petillo | 84/1.16 X |
| 4,169,402 | 10/1979 | Wood | 84/291 |
| 4,201,108 | 5/1980 | Bunker | 84/1.16 |
| 4,248,127 | 2/1981 | Lieber | 84/314 N |
| 4,356,754 | 11/1982 | Fishman | 84/1.16 |
| 4,476,770 | 10/1984 | McGowan | 84/458 |
| 4,606,255 | 8/1986 | Hayashi et al. | 84/1.16 |
| 4,616,550 | 10/1986 | Lacroix et al. | 84/173 |
| 4,646,613 | 3/1987 | Banchetti | 84/327 |
| 4,697,492 | 10/1987 | Freed | 84/1.16 |
| 4,704,935 | 11/1987 | Franklin | 84/297 R X |

OTHER PUBLICATIONS

Sievert, J.; "It's News", *Guiter Player,* 6/88, p. 136, columns 3 and 4.

*Primary Examiner*—A. T. Grimley
*Assistant Examiner*—Matthew S. Smith

[57] ABSTRACT

An electric stringed musical instrument has two separate modules: a string tension module and a set-up module. The string tension module is assigned the function of holding the string(s) at a predetermined tension. The set-up module is assigned the functions of defining the string length, bridge height and pickup height. Changes in string tension within the string tension module have no effect on operation of the set-up module in performing its assigned functions. The string tension module includes a bow, at least one string, and string tension adjusting means. The set-up module includes a bridge, fingerboard, nut and pickup. Universal joints connect the set-up module to the string tension module. The set-up module in its entirety is independently suspended with respect to the string tension module, and free of stresses set up within the bow by tensioning of the strings. The bow need not be particularly rigid, though it may be.

11 Claims, 3 Drawing Sheets

STRINGED ELECTRIC MUSICAL INSTRUMENT WITH INDEPENDENTLY SUSPENDED SET-UP MODULE

FIELD OF THE INVENTION

This invention relates the field of electric stringed musical instruments in which the strings are played by finger pressure against a fingerboard, applied at a desired position on a string, to select the desired note (frequency). The fingerboard (as the term is used herein in the specification and claims) may be either fretless (like an electric violin) or provided with frets (like an electric guitar).

PRIOR ART

Using the electric guitar as an example, the conventional instrument has a body, fretted neck (with a head) and strings as its principal parts. The strings are suspended between the bridge (affixed to the body), and the nut (affixed to the end of the neck where it widens into the head). Because the string tension is applied to the neck, a good instrument has an adjustable steel truss rod to pretension the neck against the string pull. The bridge is adjustable as to height and intonation (the length of the strings, which defines the musical scale). The "action" of the strings is defined by the height of the bridge and straightness of the neck. A low action (strings as close to the fretboard as possible) is highly desirable. This requires careful adjustment of the neck's truss rod tension and the bridge height, and also often filing of the frets and/or fret board, to achieve straightness of the neck. Also, the pickup height needs to be adjusted to correspond to bridge height. Even once a desirable action has been set, it can easily change due to warping of the neck, aging of the strings with consequent changes in tension, or a change in the string gauge desired by the musician. This leads to a need for further adjustments, which are often beyond the capability of the musician and require costly work by a skilled repair technician, with consequent delay.

The action of the guitar is one of its chief playing characteristics; a good action can make a difference of hundreds of dollars in an instrument's value. Musicians expend great effort to locate and acquire such an instrument.

The work of adjusting the action (height of bridge and nut and straightness of neck), pickup height and intonation (length of scale) is known as "set-up" work.

Certain other types of instruments are known, which may in some respects ameliorate the set-up problem. U.S. Pat. No. 2,122,396 to Freeman shows a steel guitar with a tubular metal support frame. Due to its inherent rigidity, this instrument's neck will not warp. However, it is obviously unsuited for hand-held playing. Even using a steel neck on a conventional guitar makes it too heavy for convenient use.

U.S. Pat. No. 4,616,550 to Lacroix teaches use of independent arms to support a relatively flexible neck affixed to the arm assembly by screws. However, unless these arms are extremely rigid, they will bend slightly, thus throwing off the neck set-up, since guitar string tension (six strings) totals about 150 pounds (Gibson SONOMATIC strings G-E340, 0.012 diameter on first string).

U.S. Pat. No. 3,858,480 to Schneider teaches use of a rigid rectangular frame of hardwood to which the strings, bridge and pickup are attached. The neck is connected to the frame by hinges, so that bending stresses are not transmitted from the frame to the neck. This expedient addresses the problem of poor set-up caused by warping of the neck (lack of straightness), but it does not address the related problems of bridge and nut height, pickup height and intonation adjustment, which would be caused by warping of the frame due to the tension in the strings. No doubt for this reason Schneider teaches that his frame should be rigidly constructed, having the unusual, inconvenient and unattractive shape of a rectangular picture frame.

OBJECT OF THE INVENTION

It can thus be appreciated that there is a need for an electric stringed musical instrument in which the string tension does not have a tendency to cause set-up problems with respect to any of the factors of neck straightness, bridge and nut height, pickup height and intonation; which is relatively lightweight and convenient to play; and which is aesthetically attractive. The object of the invention is to provide such an instrument.

SUMMARY OF THE INVENTION

This object is accomplished by the invention in the following manner. The instrument is conceptually divided into two separate modules: the string tension module and a set-up module. The string tension module is assigned the function of holding the string(s) at a predetermined tension. The set-up module is assigned the functions of defining the string length, bridge height and pickup height. Changes in string tension within the string tension module have no effect on operation of the set-up module in performing its assigned functions. The string tension module includes a bow, at least one string, and string tension adjusting means. The set-up module includes a bridge, fingerboard, nut and pickup. Clamps hold the set-up module to the string(s) of the string tension module. The set-up module in its entirety is thus independently suspended with respect to the string tension module, and free of stresses set up within the bow y tensioning of the strings. The bow need not be particularly rigid, though it may be.

DETAILED DESCRIPTION OF THE INVENTION

The invention will now be described in detail, with reference to the drawings.

Figure 1:
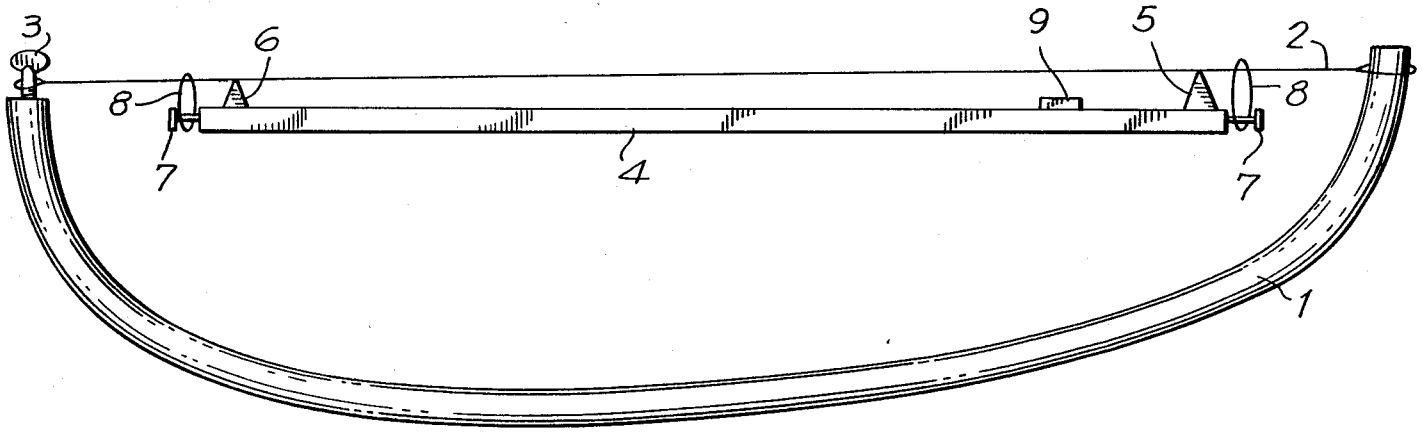
FIG. 1 is a side view of an illustrative embodiment of the invention.
Figure 2:
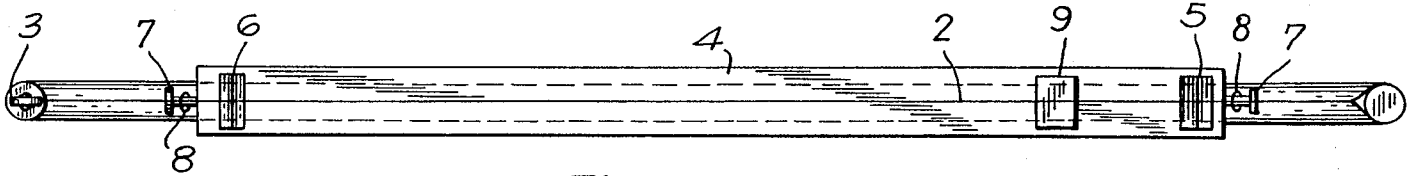
FIG. 2 is a top view thereof.
Figure 3:
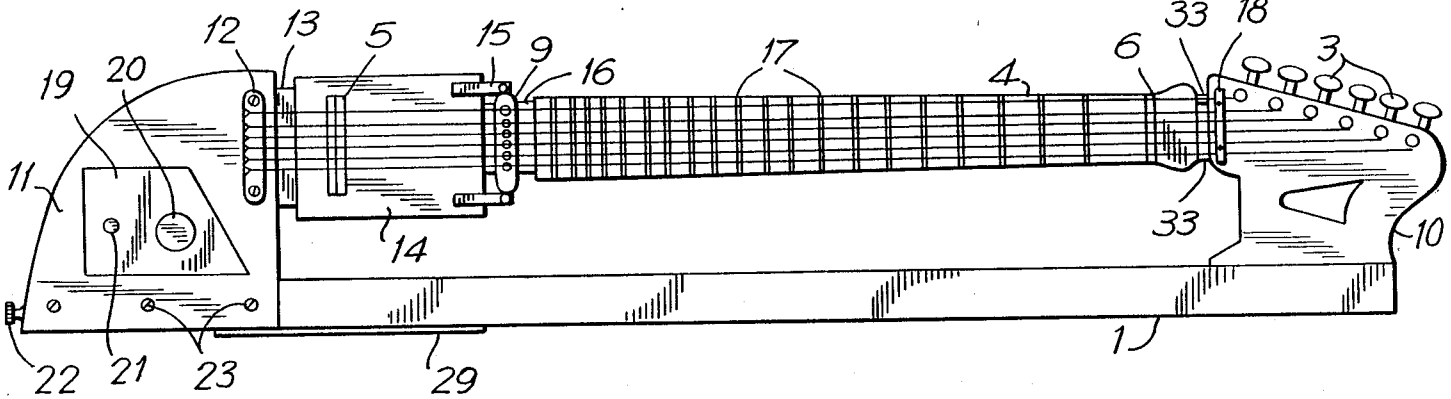
FIG. 3 is a front side view of another embodiment of the invention.

Referring to FIGS. 1 and 2, an illustrative embodiment will be explained. Bow 1 is provided with string 2, which is affixed to one end of bow 1. The other end of string 2 attaches to tuning peg 3, which is friction fit into a hole on bow 1. String 2 is a conventional metal guitar string. Tuning peg 3 tensions string 2 as desired. Bow 1 may be any resilient material, such as steel, aluminum, hardwood or reinforced plastic. These parts define a string tension module.

Suspended from string 2 is a set-up module comprising the following parts. Fingerboard 4 is provided with bridge 5 and nut 6. At its ends, fingerboard 4 has pegs 7 over which are looped rubber bands 8. Rubber bands 8 encircle string 2, applying a moderate string pressure to bridge 5 and nut 6. This pressure need only be comparable to the human finger pressure used to finger a string. Pickup 9 is also attached to fingerboard 4. It can be appreciated that the length of the fingerboard, the spacing between the bridge and nut (scale length), height of bridge and nut and pick up height (distance from the string) can all be pre-set by the builder of the instrument, or varied at will by suitable conventional adjustment mechanisms, but are essentially independent of the tension level of string 2 provided it is not entirely slack. Both non-adjustable and adjustable embodiments are encompassed within the scope of the claims, in which "pre-determined" is to be interpreted as either fixedly or selectively pre-determined.

This permits mass production, as by molding the entire set-up module out of a single piece of plastic. Moreover, lack of rigidity (bending) of bow 1 has no effect upon any of the set-up characteristics of the set-up module, because string 2, provided it is not entirely slack, always defines a straight line. Bow 1 therefore need not be (though it may be) made of especially rigid material; it can be relatively light weight, provided it has the necessary resilience.

This particular instrument is a fretless instrument like a violin, but it will be appreciated that fingerboard 4 may also be provided with frets, as desired.

The following is a description of a further, preferred embodiment, with reference to the accompanying FIGS. 3-6, which depict a six-string electric guitar.

The string tension module is constructed with bow 1 of hollow aluminum extrusion, 1½ inches square in cross section, 3/32 inch wall thickness, and 39½ inches long. Headstock 10 is attached to bow 1 with screws 24. Tailstock 11 is attached with screws 23. Tailstock 11 and headstock 10 are attached to opposite sides of bow 1. This permits fingerboard 4 to be aligned on a different axis from bow 1, improving the clearance for the player's right and left hands (the right hand strums in front of strings 2, while the left hand approaches from behind and underneath fingerboard 4).

Headstock 10 and tailstock 11 are ¾ inch oak, except for the portion of headstock 10 provided with recess 32 for mounting tuning keys 3. Recess 32 is ⅛ inch deep.

Tailstock 11 is provided with cover plate 19, housing a volume control 20 and output jack 21.

Tailpiece 12 is a conventional fitting for holding the ends of the six strings. It is mounted by screws onto tailstock 11. If necessary, its height may be adjusted with shims.

Strap fittings 22 and 25 are screwed to tailstock 11 and headstock 10, respectively. Friction strips 29, made of the loop portion of self-adhesive VELCRO tape, adhere to bow 1 and help prevent it from sliding out of position visa-vis the musician's body.

The set-up module is constructed with fingerboard 4 having frets 17 (not all are shown) and nut 6. In this embodiment, fingerboard 6 is a conventional STRATOCASTER neck, with the head cut off. However, no truss rod is needed, and the neck may be "shaved" (reduced in thickness) with no deleterious effects if desired.

Compression bar 18 is screwed to headstock 10, in order to compress strings 2 against nut 6. Strings 2 are lead between compression bar 18 and headstock 10 and are free to slide underneath said bar, to permit tuning by tuning keys 3.

Spanner block 16, made of ⅜ inch hardwood, and screws 30 connect fingerboard 4 to support block 14. Pickup 9 is suspended from support block 14 by pickup arms 15. Bridge 5 is mounted on support block 14. Bridge 5 is a conventional Gibson TUNE-A-MATIC adjustable bridge, although a fixed bridge may be used for mass production. The distance from nut 6 to bridge 5 (the scale) is about 25½ inches.

Bridge pressure plate 13 is a distinctive feature of the invention. It is attached to tailstock 11 by screws 31; but is not fixedly attached to support block 14. It acts to capture block 14 and bridge 5 between itself and strings 2, while permitting necessary freedom of movement of block 14 and bridge 5, to compensate for changes in position of tailstock 11 caused by bending of bow 1 as string tension is applied. I.e., it acts as a telescoping universal joint Plate 13 is a steel plate about ⅛ inch thick. The edge where it contacts block 14 may be rounded to act as a bearing surface.

Similarly, another distinctive feature of the invention is that the rounded underside of the end of fingerboard 4 holding nut 6 is supported by two nut support pins 33, which capture nut 6 and the end of fingerboard 4 between themselves and strings 2, as positioned by compression bar 18, while permitting the desired telescoping universal joint motion, as well as the desired relative rotational motion of fingerboard 4 with respect to headstock 10, generally about an axis parallel to the axis of strings 2. Note that in the prior embodiment of FIGS. 1-2, this desired freedom of movement (universal joint action, telescoping and rotation) was provided by the flexibility of the string ends lying in the string region other than the region intermediate the bridge and nut, along with the ability of the strings to slide over the bridge and nut.

Pick-up leads 26 connect pick-up 9 to volume control 20 and thence to jack 21. Ground wire 27 runs from pickup ground to tailpiece 12 and bow 1. Ground screw 28 holds wire 27 onto bow 1.

Figure 5:
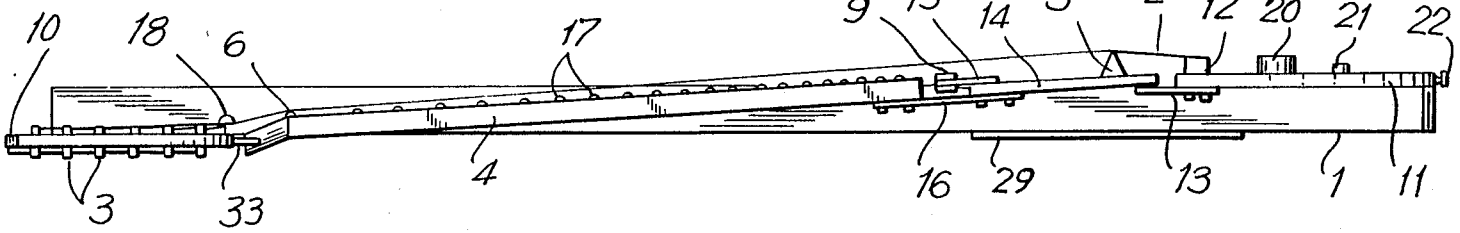
FIG. 5 is a top view thereof.

Referring to FIG. 5, note that bridge 5 must be high enough to put a slight bend in strings 2, thus holding them onto bridge 5. Note also that there is a cumulative air gap of about 1/32 to 1/16 of an inch between the ends of the set-up module, and the string tension module, when full string tension is applied. The gap is about ⅛ inch to ¼ inch when strings 2 are untensioned. Because the set-up module has freedom of movement provided by the universal joint action of bridge pressure plate 13 and nut support pins 32, distortion of bow 1 caused by string tension, which in turn causes relative movement of headstock 10 and tailstock 11, does not cause distortion of the elements of the set-up module. Bridge 5, nut 6, frets 17 and pickup 9 always retain their relative positions with respect to each other and to strings 2, precisely as predetermined by the manufacturer or adjusted by the musician.

Figure 6:
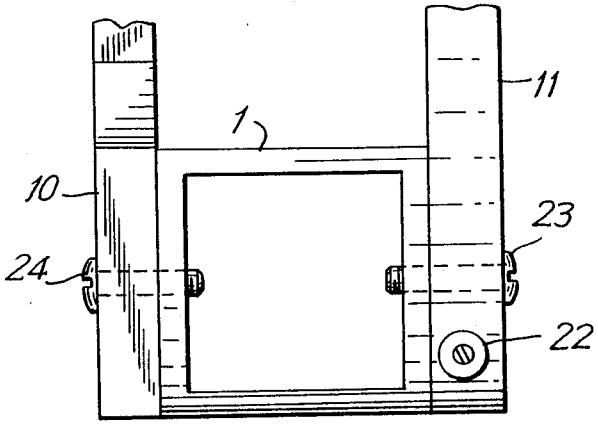
FIG. 6 is a partial end view thereof.
Figure 4:
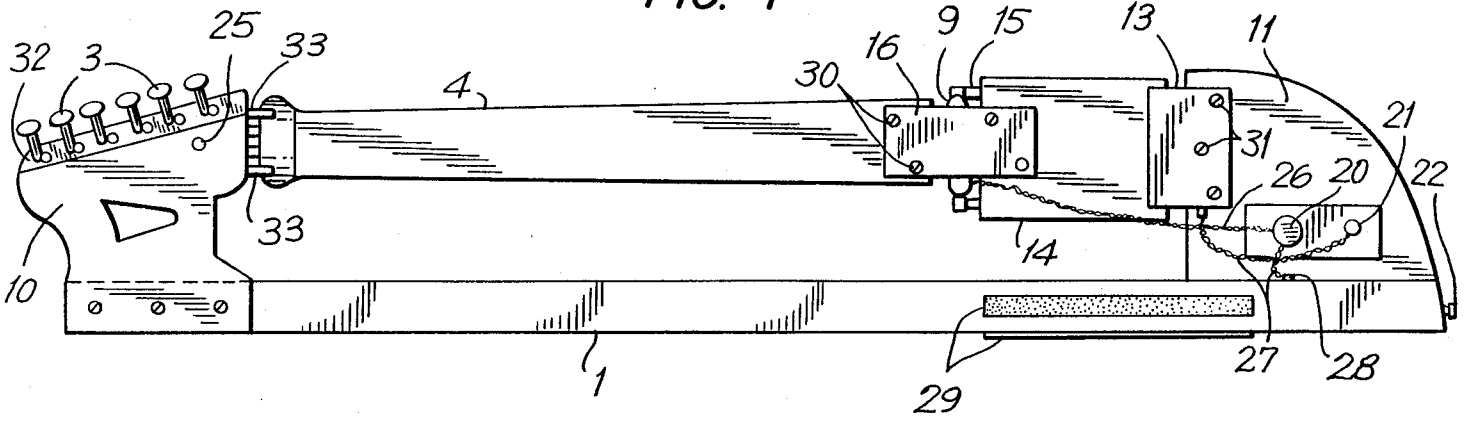
FIG. 4 is a rear side view thereof.

Referring to FIG. 6, note how headstock 10 and tailstock 11 are secured by screws 23 and 24 to opposite sides of bow 1.

The entire assembly weights no more than a conventional solid body electric guitar; it is comfortable to play, either standing or sitting; it is attractively shaped; it is made of inexpensive, readily available materials; and it utilizes a minimum of parts, all of which are easy to fabricate with simple tools, or on an automated basis with appropriate mass production machinery. No difficult and costly set-up work is required either on initial manufacture or at any later time, as is so common with conventional instrument.

I claim:

1. An electric stringed musical instrument comprising:

at least one string;

first means for tensioning said string, said first means being resiliently deformable by string tension at levels encountered in normal use;

second means for positioning a nut, bridge, fingerboard and pickup in predetermined spatial relation with respect to each other and with respect to an axis defined by the portion of said tensioned string intermediate said nut and bridge;

third means for urging said string against said nut;

fourth means for urging said string against said bridge;

said first means being structurally connected to said second means substantially only in the regions of said nut and said bridge; and said predetermined spatial relation of said nut, bridge, fingerboard and pickup being maintained regardless of the resilient deformation of said first means, due to the relative independent action of said first means with respect to said second means.

2. An instrument according to claim 1, said first means comprising a bow having a headstock and a tailstock.

3. An instrument according to claim 2, said headstock and said tailstock being positioned on opposite sides of said bow.

4. An instrument according to claim 1, said first means being connected to said second means by first and second joints, each of said joints permitting angular deflection in two planes; at least one of said joints being telescoping; and at least one of said joints permitting relative rotational movement between the portion of said first means and the portion of said second means which are connected by said one of said joints.

5. An instrument according to claim 4, said third means comprising at least one pin for supporting said neck, and means for urging said string against said nut; and said fourth means comprising means for supporting said bridge, and means for urging said string against said bridge.

6. An instrument according to claim 1, the degrees of deflection, telescoping and rotation permitted by said joints acting in combination, being sufficient to substantially prevent forces induced by tensioning of said string, from deforming said second means.

7. An instrument according to claim 1, said string being tunable by tuning means; and said fingerboard being provided with frets.

8. An electric stringed musical instrument comprising:

a first module comprising a fingerboard, nut, bridge and at least one pickup, said first module having two longitudinal extremities;

a second module comprising a plurality of strings and means for tensioning said strings; and first and second means for flexibly connecting each of said two longitudinal extremities of said first module to said second module, respectively, said first and second means for flexibly connecting said modules comprising, respectively, first and second joints each permitting angular deflection in two planes; at least one of said joints being telescoping; and at least one of said joints permitting relative rotational movement between the portion of said first module and the portion of said second module which are connected by said one of said joints.

9. An instrument according to claim 8, said first module being positioned with respect to said second module substantially only by said joints.

10. An instrument according to claim 8, said second module being external to said first module; and said second module further being capable of motion relative to and independent of said first module.

11. An instrument according to claim 8, the degrees of deflection, telescoping and rotation permitted by said joints acting in combination, being sufficient to substantially prevent forces induced by tensioning of said strings, from deforming said first module.

* * * * *